US007199759B2

(12) United States Patent
Noguchi et al.

(10) Patent No.: US 7,199,759 B2
(45) Date of Patent: Apr. 3, 2007

(54) ANTENNA MODULE

(75) Inventors: Toshiharu Noguchi, Miyazaki-gun (JP); Munenori Fujimura, Miyazaki (JP); Hiromi Tokunaga, Miyazaki-gun (JP); Keisuke Maruyama, Koyu-gun (JP); Yoshitaka Mizoguchi, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 139 days.

(21) Appl. No.: 11/006,549

(22) Filed: Dec. 8, 2004

(65) Prior Publication Data

US 2005/0231429 A1 Oct. 20, 2005

(30) Foreign Application Priority Data

Dec. 10, 2003 (JP) ..... P. 2003-411477

(51) Int. Cl.
*H01Q 1/24* (2006.01)

(52) U.S. Cl. ..... 343/702; 343/700 MS; 343/895

(58) Field of Classification Search ..... 343/702, 343/700 MS, 895
See application file for complete search history.

(56) References Cited

U.S. PATENT DOCUMENTS 5,461,386 A 10/1995 Knebelkamp
5,561,430 A 10/1996 Knebelkamp
5,600,323 A * 2/1997 Boschini ..... 341/173
5,764,197 A 6/1998 Tsuru et al.
5,898,413 A 4/1999 Mandai et al.
5,903,242 A 5/1999 Tsuru et al.
5,914,693 A 6/1999 Takei et al.
5,936,593 A 8/1999 Mandai et al.
5,949,385 A 9/1999 Asakura et al.
5,973,651 A 10/1999 Suesada et al.
5,977,927 A 11/1999 Mandai et al.
6,028,554 A 2/2000 Mandai et al.
6,054,956 A 4/2000 Mandai et al.
6,064,351 A 5/2000 Mandai et al.
6,181,001 B1 1/2001 Ikefuji et al.
6,288,680 B1 9/2001 Tsuru et al.

(Continued)

FOREIGN PATENT DOCUMENTS

EP 0764999 3/1997

(Continued)

OTHER PUBLICATIONS

International Search Report dated Mar. 1, 2005.

(Continued)

*Primary Examiner*—Hoang V. Nguyen
*Assistant Examiner*—Dieu Hien Duong
(74) *Attorney, Agent, or Firm*—Stevens, Davis, Miller & Mosher, LLP

(57) ABSTRACT

The invention is to provide such an antenna module making broadband of transmitting and receiving frequencies, while realizing miniaturization. The invention has a structure comprising a mounting body; a chip antenna having a substrate mounted on the mounting body and a substrate and a couple of terminal parts provided on the substrate; an feeding portion to which one of the terminal parts provided on the mounting body is connected; a open portion to which the other of the terminal parts provided on the mounting body is connected; and a capacitive conductor provided in opposition to the substrate, thereby to make use of a bottom area hidden when mounting the chip antenna so as to increase capacitive components for realizing broadband of the antenna module.

17 Claims, 12 Drawing Sheets

U.S. PATENT DOCUMENTS

| | | | | |
|---|---|---|---|---|
| 6,486,853 | B2 | 11/2002 | Yoshinomoto et al. | |
| 6,600,459 | B2 * | 7/2003 | Yokoshima et al. | 343/895 |
| 6,639,559 | B2 * | 10/2003 | Okabe et al. | 343/700 MS |
| 6,680,700 | B2 * | 1/2004 | Hilgers | 343/700 MS |
| 6,693,604 | B2 | 2/2004 | Washiro et al. | |
| 6,958,730 | B2 | 10/2005 | Nagumo et al. | |
| 6,985,544 | B2 * | 1/2006 | Matsui et al. | 375/347 |
| 7,061,434 | B2 * | 6/2006 | Aoyama et al. | 343/702 |
| 2002/0033778 | A1 | 3/2002 | Yoshinomoto et al. | |
| 2003/0011532 | A1 | 1/2003 | Yoshinomoto et al. | |
| 2004/0108967 | A1 | 6/2004 | Fujimura et al. | |

FOREIGN PATENT DOCUMENTS

| | | |
|---|---|---|
| EP | 0831546 | 3/1998 |
| EP | 0863571 | 9/1998 |
| EP | 0872912 | 10/1998 |
| EP | 1239533 | 9/2002 |
| EP | 1313169 | 5/2003 |
| JP | 5013291 | 1/1993 |
| JP | 5226926 | 9/1993 |
| JP | 9199939 | 7/1997 |
| JP | 10065432 | 3/1998 |
| JP | 10200438 | 7/1998 |
| JP | 10247806 | 9/1998 |
| JP | 10313208 | 11/1998 |
| JP | 11004117 | 1/1999 |
| JP | 2002 124812 | 4/2002 |
| JP | 2002 319810 | 10/2002 |
| JP | 2003 101342 | 4/2003 |
| JP | 2003 163521 | 6/2003 |
| WO | 0070710 | 11/2000 |

OTHER PUBLICATIONS

Patent Abstract of Japan, vol. 1999, No. 02, Feb. 26, 1999, JP 10-313208.

Office Action dated Jan. 24, 2006 in U.S. Appl. No. 10/928,118.

Office Action dated Jun. 14, 2006 in U.S. Appl. No. 10/928,118.

Information Disclosure Statement and PTO-1449 dated Aug. 8, 20004 in U.S. Appl. No. 10/918,118.

Information Disclosure Statement and PTO-1449 dated Jan. 25, 2005 in U.S. Appl. No. 10/918,118.

* cited by examiner

ANTENNA MODULE

BACKGROUND OF THE INVENTION

The present invention relates to an antenna module suitably used to electronic instruments performing wireless communications such as mobile communications or personal computers.

There have recently been more portable terminals mounted with antenna modules provided for performing wireless data communications to other electronic instruments in addition to whip antennas or built-in antennas provided for voice communication.

Besides, there have also been increased portable mobile electronic instruments such as notebook personal computers, using wireless LAN for performing wireless data communications; therefore, many of the electronic instruments have the antenna modules therein.

Further, in the recent portable telephones or notebook personal computers, miniaturization and low consumption of electric power are indispensable requirements, and an antenna device has been demanded to reduce its dimension. In addition, with increase of transmitting capacity, a broadband antenna has been required. A multi carrier system such as OFDM (Orthogonal Frequency Division Multiplexing) has more been required the broadband antenna.

Herein, for realizing the broadband and increasing the load capacity of the antenna, studies have been made on the antenna module added with an additional conductor at a lead end of the antenna (see, for example, Japanese Patent Publication No. 2002-124812 or No. 10-247806/(1998). FIG. 18 is a perspective view of the antenna module according the conventional art, and shows that the additional conductor is added to the lead end of the antenna element.

Numeral 100 designates the antenna module, 101 designates a meander antenna, 102 is an feeding portion, and 103 is an additional conductor. The meander antenna 101 is formed by a substrate pattern. The additional conductor 103 is provided at the lead end of the meander antenna 101, and this lead end is open ended. A signal current is applied from the feeding portion 102, and the applied signal is radiated in accordance with a resonance frequency of the meander antenna 101. Similarly, the signal is received. Then, the additional conductor 103 works as the load capacity, load impedance seen from the feeding portion 102 is increased, a peak of frequency curve is moderated, and the frequency band is broadened.

However, when providing the additional conductor at the lead end of the pattern antenna as the meander antenna, there has been a problem that the antenna module is large scaled, because the pattern antenna itself requires a large area.

In particular, for further advancing the broadband, the load capacity at the lead end of the antenna must be made large sized, but if being too large sized, the area at the lead end of the antenna becomes accordingly large sized, so that a problem occurs that the antenna module and the electronic instrument incorporating the antenna module are very much oversized. Further, being too large sized, a balance cannot be kept with an effect of making broadband, and efficiency is not sufficiently brought about in comparison with the large scale.

SUMMARY OF THE INVENTION

Accordingly, it is an object of the invention to provide such an antenna module making broadband of transmitting and receiving frequencies, while realizing miniaturization.

The invention is provide a structure comprising a mounting body, a chip antenna mounted on the mounting body and having a substrate and a couple of terminal parts provided on the substrate, a feeding portion to which one of the terminal parts provided on the mounting body is connected, an open part to which the other of the terminal parts provided on the mounting body is connected, and a capacitive conductor provided between the mounting body and the substrate.

The invention arranges the capacitive conductor in opposition to the helical part provided on the substrate, thereby enabling to generate a capacitive component parallel to a capacity existing in the substrate. Further, it is possible to easily increase an overall capacitive value owing to the parallel capacitive component, and to progress the broadband.

Since the capacitive conductor exists on a bottom of the chip antenna when mounting the chip antenna, the capacitive conductor is more efficient than providing a large additional conductor at the lead end of the chip antenna, not requiring an excessive mounting area. That is, an effect of making the broadband is further increased, curtailing the mounting area necessary as a whole. In short, it is possible to make efficient use of a wasteful area created when mounting the chip antenna but not used to mounting of other parts, and to increase the capacitive component for realizing the broadband. The antenna is not therefore made large sized but can be maintained to be small sized.

Further, it is possible to realize multiple resonances when connecting a plurality of chip antennas, and make the broadband by the efficient mounting area.

Also when connecting a plurality chip antennas, since it is sufficient to arrange the capacitive conductor on the mounting body hidden by the chip antenna, an excessive mounting area is not required, and besides it is unnecessary to provide more or large scaled additional conductor. Therefore, although being very small sized, the antenna module of the broadband can be realized.

With such a small sized broadband antenna module, the electronic instrument incorporated there with can be much reduced in dimension.

Incidentally, in the present description, although the additional conductor, connecting conductor, and capacitive conductor are nominally different, each of them is the conductor prepared in the same way, for example, they are a pattern, land area and metallic film, and generate the capacitive component.

Further, the mounting body is meant by a mounting board formed with epoxy, a part of a case of the electronic instrument, or abase formed with other resins, i.e., such a substance mounted thereon with many elements as the chip antenna, wiring, patterns, or electrodes.

DETAILED DESCRIPTION OF THE PREFERRED EMBODIMENTS

In the following description, explanation will be made, referring to the attached drawings.

(Embodiment 1)

Figure 1:
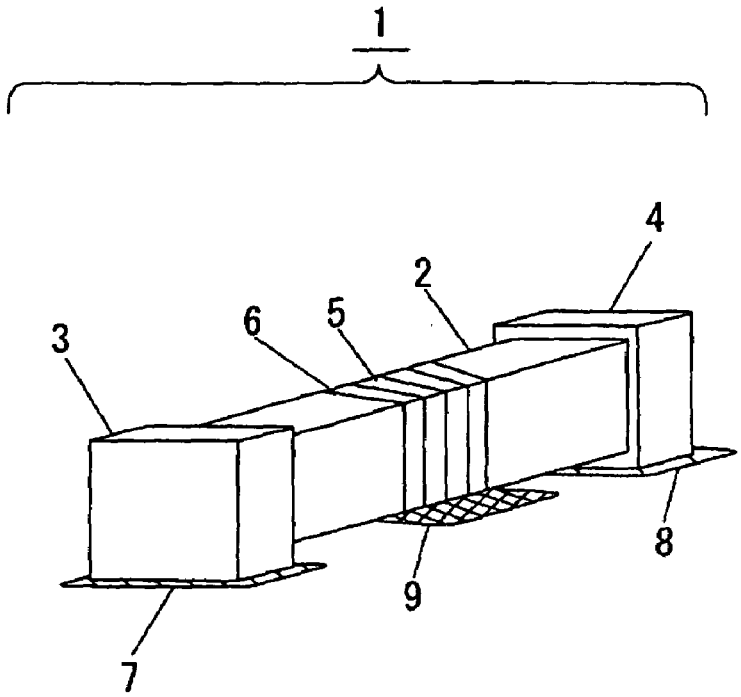
FIG. 1 is a perspective view of the antenna module in Embodiment 1 of the invention.
Figure 2:
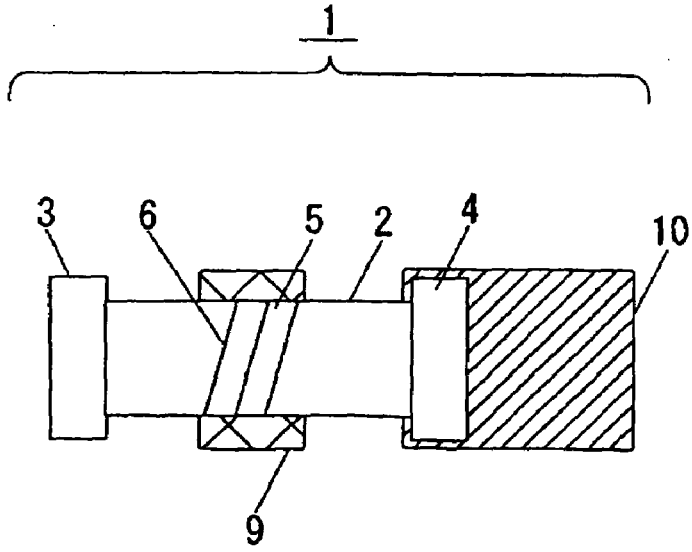
FIG. 2 is a structural view of the antenna module in Embodiment 1 of the invention.
Figure 3:
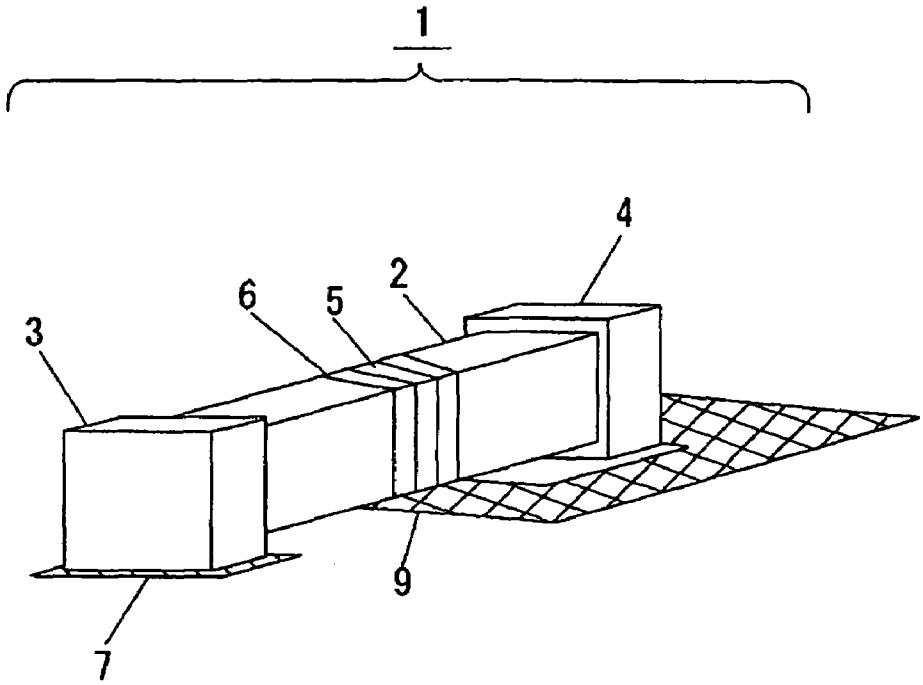
FIG. 3 is a perspective view of the antenna module in Embodiment 1 of the invention.
Figure 4:
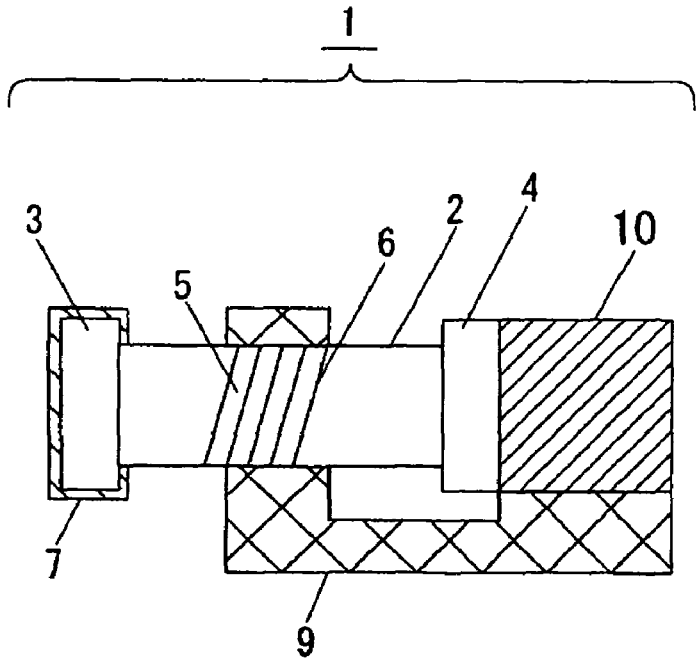
FIG. 4 is a structural view of the antenna module in Embodiment 1 of the invention.
Figure 5:
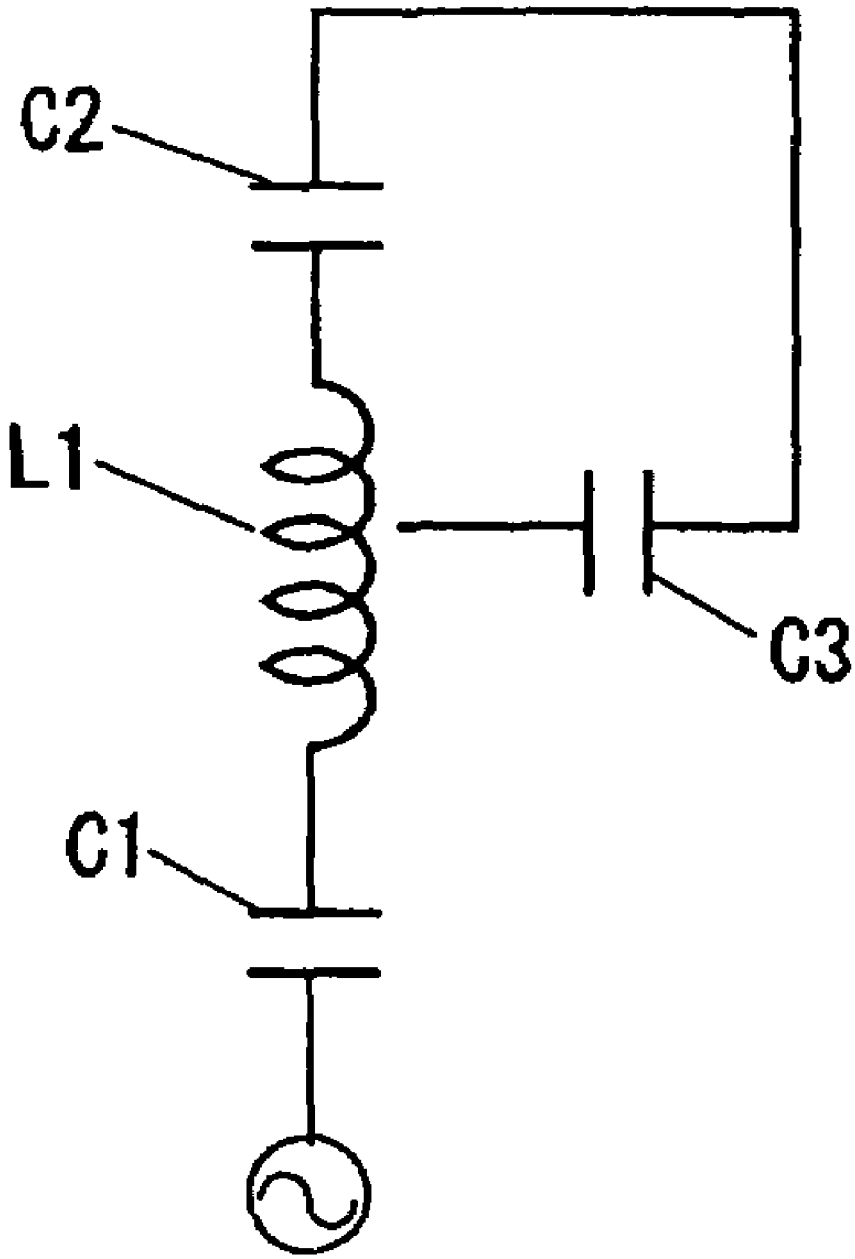
FIG. 5 is an equivalent circuit diagram of the antenna module shown in FIG. 3.
Figure 7:
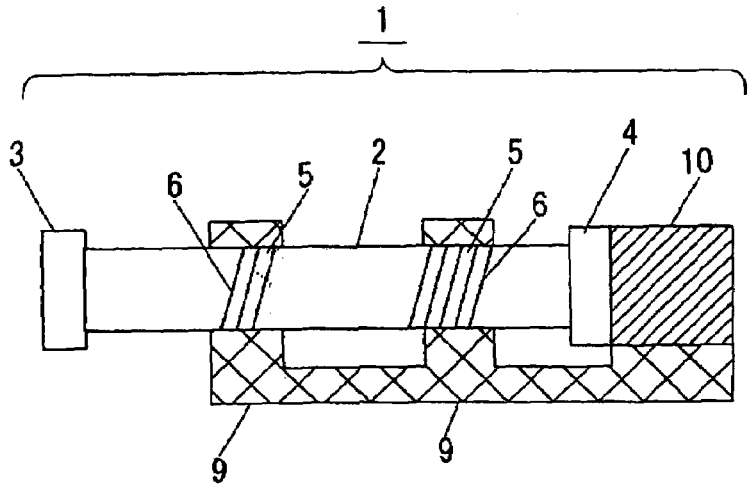
FIG. 7 is a structural view of the antenna module in Embodiment 1 of the invention.
Figure 8:
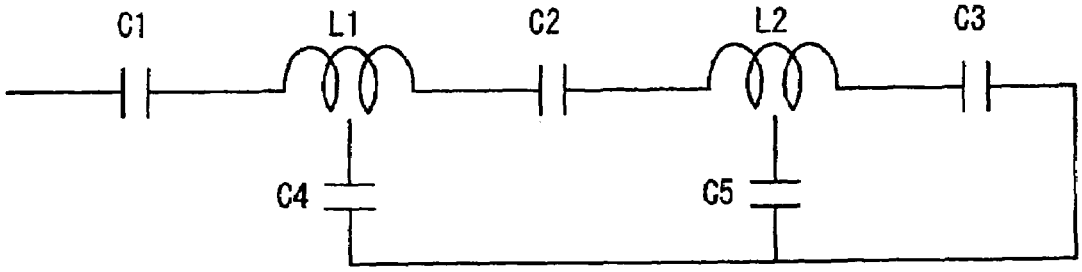
FIG. 8 is an equivalent circuit diagram of the antenna module shown in FIG. 7.
Figure 16:
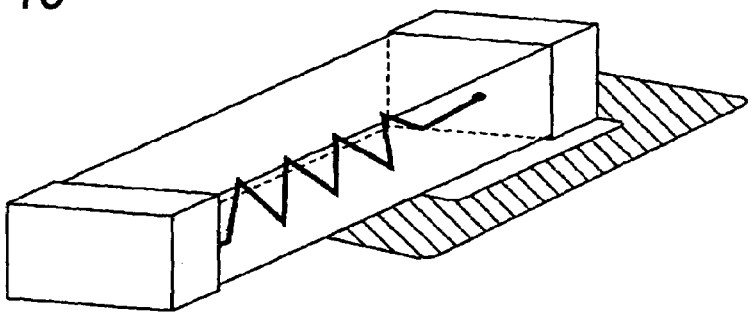
FIG. 16 is a perspective view of another antenna module in Embodiment 1 of the invention.
Figure 17:
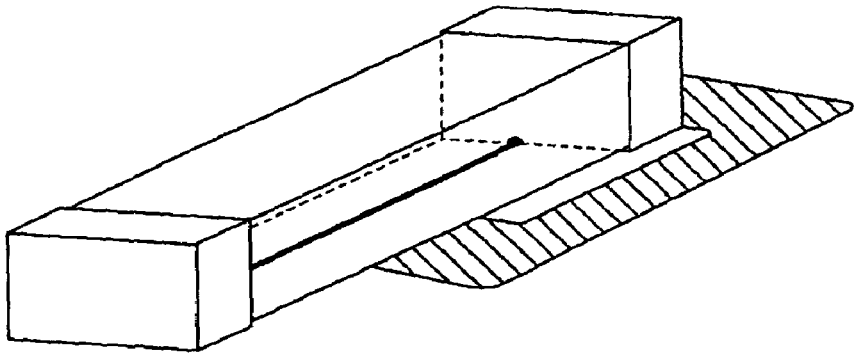
FIG. 17 is a perspective view of a further antenna module in Embodiment 1 of the invention.
Figure 18:
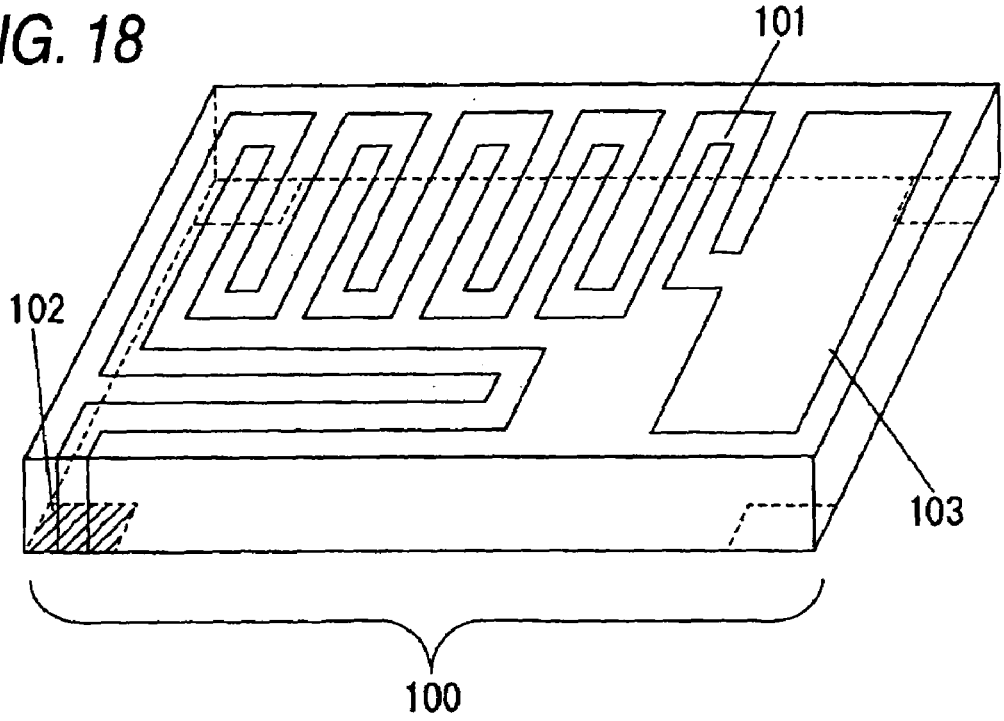
FIG. 18 is a perspective view of the antenna module of the prior art technique.

FIG. 1 and FIG. 3 are perspective views of the antenna module in the embodiment 1 of the invention, and FIG. 2, FIG. 4 and FIG. 7 are structural views of the antenna module in the embodiment 1 of the invention. FIG. 5 is an equivalent circuit diagram of the antenna module shown in FIG. 3. FIG. 8 is the equivalent circuit diagram of the antenna module shown in FIG. 7. FIG. 16 and FIG. 17 are perspective views of the other antenna modules in the embodiment 1 of the invention.

Numeral 1 designates the chip antenna, 2 designates the substrate, 3 and 4 are terminal parts, 5 is the helical part, 6 is spiral grooves, 7 is the feeding portion, 8 is the open portion, and 9 is the capacitive conductor. The mounting body mounting these members thereon is not shown.

The chip antenna 1 is composed in that the terminal parts 3, 4 are provided at both ends of the substrate 2, a helical part 5 is defined by forming a spiral grooves 6 formed in such a manner that a conductive film covering the substrate 2 is subjected a laser trimming or the like, and the terminal part 3 is connected to the feeding portion 7, while the terminal part 4 is connected to the open portion 8.

At first, the chip antenna 1 will be explained with reference to FIGS. 1 and 2.

The substrate 2 is formed by pressing or extruding an insulator or dielectric substance made of alumina or a ceramic material having a main ingredient of alumina. There are available, as a materials of the substrate 2, ceramic material such as forsterite, magnesium titanate group, calcium titanate group, Zr—Sn—Ti group, barium titanate group, or Pb—Ca—Ti group. Additionally, a resin material such as epoxy resin is also sufficient. From the viewpoint of strength, insulating property, or processing easiness, alumina or ceramic material having the main ingredient being alumina is employed in this embodiment. In addition, the substrate is laminated all over with a single layer or a plurality of layers of the conductive film composed of conductive materials such as Cu, Ag, Au or Ni, and the surface having conductivity is formed. The conductive film is formed by plating, evaporation, spattering, or paste.

The terminal parts 3, 4 are formed at both ends of the substrate 2, and at least one is employed from a conductive plated film, an evaporated film or spattered film, or a film coated with a silver paste and baked.

The substrate 2 may have a cross section of the same size as those of the terminal parts 3, 4, and the cross sectional area of the substrate 2 may be smaller than those of the terminal parts 3, 4 to have a step difference. If the substrate 2 has the step difference on the outside periphery, the substrate 2 enables, when mounting, to have a distance from the surface of the antenna mount body, and to avoid deterioration of the characteristics. The step difference may be provided on one part of the substrate 2 or overall thereon. In case providing the step difference on the overall substrate 2, when mounting, it is unnecessary to pay attentions to selection of a face contacting the electronic board, resulting in lowering cost for mounting.

The substrate 2 may be treated at corners with chamfering. If chamfering the corners, the substrate 2 is prevented from cutout, the conductive film is prevented from becoming thinner, and the spiral groove 6 is prevented from damages.

Herein, the substrate 2 and the terminal parts 3, 4 may be formed separately, and thereafter they are pasted as one body. The substrate 2 is not necessarily square, but may be polygonal as triangular, pentagonal or cylindrical. In case of a cylinder, shock resistance is increased because of absence of corner, and it has a merit of easily forming the spiral grooves.

The spiral groove 6 is made the helical part 5 by spirally laser-trimming the surface of the substrate 2 covered with the conductive film, and the helical part 5 has an inductor component. The inductor component formed by the helical part 5 is electrically connected to the terminal parts 3, 4. The chip antenna 1 may be wound with the conductive wire such as copper wire on the substrate 2, instead of the trimmed groove 6.

If covering the protective film on the outside periphery of the chip antenna 1 except the terminal parts 3, 4, the durability is desirably increased. At this time, in the helical part, the protective film may be undone only on a portion in opposition to the capacitive conductor 9. In this case, a merit is that no attention is given to dielectric constant in the capacitive coupling of the helical part 5 and the capacitive conductor 9. Reversely, the existence of the protective film brings about a merit that the dielectric constant goes up, and a coupling capacity value is heightened, so that the capacity value mainly caused by the capacitive conductor 9 can be made large.

The chip antenna 1 may be $\lambda/4$ type antenna or $\lambda/2$ type antenna. For progressing the miniaturization, $\lambda/4$ type antenna is frequently used, and this case makes use of image current generated in a ground face existing around the chip antenna 1 for securing transmitting and receiving gains.

The terminal part 3 is coupled with the feeding portion 7, while the terminal part 4 is coupled with the open portion 8. The feeding portion 7 and the open portion 8 are a mounted land, a metal film, and a soldered face, which are respectively provided on the mounting body. These members may be formed not only on the surface of the mounting body but in the interior layer of the multi-layered board.

A signal current is applied from the feeding portion 7 via the terminal part 3 to the chip antenna 1, and is emitted from the chip antenna 1. Reversely, in case of receiving signals, an induced current is generated by an electric wave received at the chip antenna 1, and the generated induced current is received from the terminal part 3 via the feeding portion 7. As to the received signal current, data is reproduced by wave detection or demodulation so as to execute wireless communications. The same is applied to signal transmittance. That is, the chip antenna 1 plays an important role as an entrance and exit of the wireless communications.

It is sufficient to compose the open portion 8 with the ordinary mounting land similarly the feeding portion 7, and if enlarging the area thereof, the broadband can be suitably attained by making the additional conductor added at its lead end.

FIG. 2 shows a condition that the additional conductor 10 is formed on the mounting body. The additional conductor 10 is coupled with the terminal parts 4, and the chip antenna 1 is realized by the mounted land, the metal film or the soldered face. If the additional conductor 10 has the same as or wider width than that of the chip antenna 1, the whole area in the width direction may be reduced. Of course, it is desirable to appropriately change shapes or sizes of the additional conductor 10 in relation with the shape of the board to be mounted or other mounted parts.

The capacitive conductor 9 is provided on the mounting body in opposition to the helical part 5 of the chip antenna 1. Similarly to the open portion and the feeding portion, the capacitive conductor may be provided not only on the surface of the mounting body but also in the inside layer of the multi-layered board. The capacitive conductor 9 is provided with the mounted land, the soldered face and the metal film on the antenna substrate mounted on the chip antenna 1. The pattern conductor is also available. The capacitive conductor 9 having a filler such as the protective film in relation with the helical part 5 may be opposed, and the capacitive conductor 9 and the helical part 5 may be oblique, not being almost parallel.

Herein, the capacitive conductor 9 is preferably provided in agreement with the position of the helical part 5 in the substrate 2. For example, it is better to bring the capacitive conductor 9 to a position present of the helical part 5 than to bring the capacitive conductor to a position absent of the helical part 5 in the substrate 2. It is sufficient to mount in advance the capacitive conductor 9 on the mounting body similarly to the feeding portion 7, the open portion 8 and the additional conductor 10, and approach the capacitive conductor 9 to the helical part 5 by mounting the chip antenna 1 thereon. In this case, the position of the capacitive conductor 9 is an advance brought to approach the helical part 5.

The capacitive conductor 9 may be provided on the mounting body, the capacitive conductor 9 may be further continued to the soldered face on the mounting body, and the capacitive conductor 9 may be provided between the substrate 2 and the mounting body such that capacity is generated between the substrate 2 and the mounting body.

At this time, an opposing distance is much approached, and this distance should provide a capacitive couple with at least the helical part 5, but a determined distance is necessitated. For example, if the outside periphery of the substrate 2 has the step difference in comparison with the terminal parts 3, 4, since the substrate 2 has a slight space that the mounting body, there exists the capacitive conductor in this space portion, and the capacitive conductor directly easily secures the determined distance with respect to the helical part 5. Thereby, the helical part does not directly contact the capacitive conductor 9, and since a direct conduction is not provided, bad influences do not exist to the antenna performance such as VSWR.

It is sufficient that the capacitive conductor 9 has the width not exceeding or wider that of the chip antenna 1. In this case, it is possible to keep the area of the antenna module in the width direction as remaining small. The capacitive conductor is provided at the position approaching the helical part, that is, the position in opposition to the helical part, and at this time, as later mentioned, the capacitive conductor is the capacitive component having an electric field coupling, and since the capacitive value is determined by the area or the dielectric constant, it is desirable to select the area, shapes or materials, taking them into consideration.

In reference to FIGS. 3 and 4, further explanation will be made to a case that the capacitive conductor 9 is coupled with the additional conductor 10.

FIGS. 3 and 4 show an embodiment that the capacitive conductor 9 and the additional conductor 10 are coupled. The conductors have a pattern that additional conductor 10 is bent, brought back, and again bent back, so that the capacitive conductor 9 is provided on the bottom of the helical part 5. Thus, the capacitive conductor 9 is provided at the face in opposition to the helical part 5. Even in this case, if the feeding portion 7 and the additional conductor 10 and the capacitive conductor 9 are previously placed on the mounting body, taking the size of the chip antenna 1 and the position of the helical part into consideration, and thereafter mounted thereon with the chip antenna 1, the capacitive conductor 9 is preferably positioned on the bottom of the helical part 5.

Next, operation of the antenna module will be explained with FIG. 5 showing an equivalent circuit diagram, in which the additional conductor 10 and the capacitive conductor 9 are connected, and the capacitive conductor 9 is positioned on the bottom of the helical part 5.

At first, when the inductor component and the capacitive component are connected in series, the resonance frequency is decided by Formula (1).

$$\varpi_0 = \frac{1}{\sqrt{LC}} \tag{1}$$

The basic antenna having the inductor component by the helical part 5 is decided by a square root of a product of the inductor component and the capacitive component, whereby the chip antenna 1 performs signal transmittance and receipt of by the resonance frequency decided by Formula (1).

Since Q value of the antenna is decided by Formula (2), the larger C as the capacitive value is, the lower Q value can be reduced. By lowering Q value, the frequency characteristic of input impedance of the antenna can be flattened, and the signal transmittance and receipt of the antenna are possible over the broadband. That is, the capacitive component as the load capacity moderates the startup and the fall of the peak of the frequency characteristic, and as a result, the broadband of the antenna is realized.

$$Q = \frac{1}{R}\sqrt{\frac{L}{C}} \tag{2}$$

In FIG. 5, L1 designates the inductor component caused by the helical part 5, C1 designates the capacitive component caused from one part of the terminal part 3 or the substrate 2, C2 is the capacitive component caused from the additional conductor 10, and C3 is the capacitive component caused from the capacitive conductor 9. There are the capacitive components caused from the substrate 2 or the terminal parts 3, 4 other than the above mentioned, but those are explained to be included in C1, C2, or C3.

L1 and C3 have the capacitive coupling, and C2 and C3 have the parallel coupling. As a result, the composite capacity of the antenna module is expressed by Formula (3).

$$C = \frac{C1(C2 + C3)}{C1 + C2 + C3} \tag{3}$$

As apparently from Formula (3), if C3 is large, the composite capacity is large. That is, if the capacitive conductor 9 is present, the capacitive component can be easily increased, even though the size of the antenna module is not enlarged. If the capacitive component is increased, the broadband of the resonance frequency is possible as apparently from Formula (2).

It is preferable to secure the sufficient capacitive component for realizing the broadband. However, as having discussed in the prior art technique, the problem is that if adding a large capacity at the lead end of the antenna, the antenna becomes large scaled. On the other hand, the invention provides the capacitive conductor at the position opposite to the helical part 5, that is, at the position approaching the bottom, and increases the capacitive component as later mentioned, not making the antenna large scaled. The position where the capacitive conductor 9 is present is a part to be hidden by mounting the chip antenna 1 and is an area not used originally. Perceiving this position, the capacitive conductor 9 is arranged to increase the capacitive component of the whole antenna module.

As mentioned above, by providing the capacitive conductor 9 at the face opposite to the helical part 5, the composite capacity is increased, and the broadband is realized, not making the antenna module large scaled. At this time, the resonance frequency is decided by the inductor component and the capacitive component, and considering this point, it is desirable to provide the helical part 5 generating the inductor component, the additional conductor 10, and the capacitive conductor 9.

Next, explanation will be made through an experiment to that the broadband is realized.

Figure 6A:
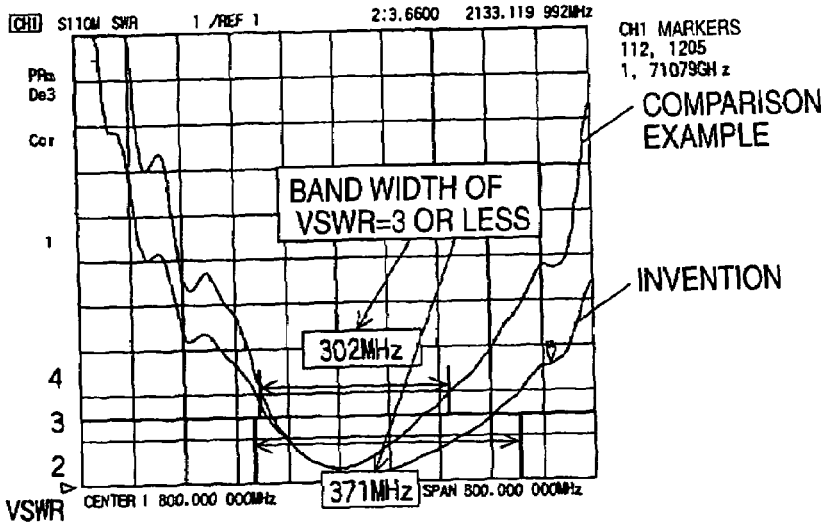
FIG. 6A is a frequency characteristic diagrams of the comparison example and the invention.
Figure 6B:
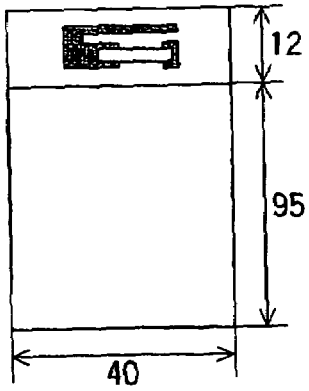
FIG. 6B is a structural diagram of the antenna module as the comparison example.
Figure 6C:
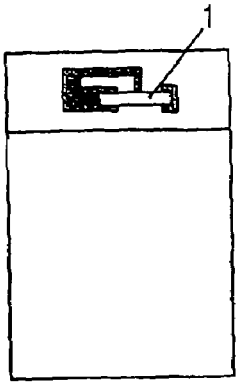
FIG. 6C is a structural diagram of the antenna module of the invention.

FIGS. 6A to 6C show the experimented results in Embodiment 1 of the invention, FIG. 6A is the frequency characteristic diagrams of the comparison example and the invention; FIG. 6B is the structural diagram of the antenna module as the comparison example; and FIG. 6C is the structural diagram of the antenna module of the invention. As apparently from FIG. 6B, the antenna module of the comparison example is only connected with the additional conductor, and the capacitive conductor is absent on the bottom of the helical part. In contrast, as apparently from FIG. 6C, the antenna module of the invention has the capacitive conductor disposed on the bottom.

As is seen from the frequency characteristic diagram of FIG. 6A, in the invention, the frequency band is much expanded. Comparing with the band width of VSWR being 3 or less, the prior art technique shows around 302 MHz, while the invention realizes enlargement of around 371 MHz and 70 MHz. From this fact, it is seen that even if the data amount must be enlarged, the antenna module of the invention can satisfy the necessity.

As is seen from FIGS. 6B and 6C, since the capacitive conductor is arranged in the area to be hidden by mounting the chip antenna, any excessive and new mounting area is not necessary, and the antenna module is not made large scaled. If the antenna has an equivalent size, the invention enlarges the broadband performance in comparison with the comparison example, and reversely, if getting the same performance, the comparison example cannot avoid enlargement of the antenna.

From the experiment, it is seen that although being small scaled, the antenna module of the invention very largely realizes the broadband.

Next explanation will be made to a case of realizing multiple resonances with one chip antenna.

FIG. 7 shows the structure provided with a plurality of helical parts 5 on the substrate 2 of one chip antenna. This structure is realized by carrying out the trimmings to the conductive films provided on the surfaces of the two parts by such as the laser, taking a space therebetween. In this case, two helical parts 5 having the inductor component are provided, and accordingly two resonance frequencies are caused. That is, there are the resonance condition which is decided by the inductor component of a first helical part and the capacitive component, as well as the resonance condition which is decided by both inductor components of the first helical part and a second helical part 5, and the capacitive component.

Even in such a case, if disposing capacitive conductors 9 on the bottoms of the two helical parts 5, the capacitive component can be effectively increased as explained in Embodiment 1. It is sufficient to dispose the capacitive conductors 9 on both bottoms of the two helical parts 9 or on either one. Further, similarly to Embodiment 1, preferably, the capacitive conductor 9 is connected to the additional conductor 10. At this time, if determining the width directions of the additional conductor 10 or the capacitive conductor 9 to be equivalent to or nearly equivalent to the width of the chip antenna 1, the antenna module can be miniaturized.

FIG. 8 is the equivalent circuit diagram of the antenna module shown in FIG. 7, and C4 and C5 are the capacitive components caused from the capacitive conductor 5. C3, C4 and C5 are connected in parallel, and therefore, the composite capacity is increased in that either one or both C4 and C5 are increased. Thereby, the whole capacitive value is large, and since the capacitive value of the antenna module is large, the broadband is realized.

Although being the chip antenna corresponding to multiple resonances, if disposing the capacitive conductor in opposition to the helical parts, the broadband can be realized as maintaining the antenna miniaturized.

The above mentioned description has explained the case of using the helical antenna, and the same is applied to any antennas, for example, a winding typed helical antenna wound with a Cu wire on the substrate, the pattern antenna in the meander shape or a conductor antenna formed from the conductor.

Such a chip antenna is also enough, which is furnished with a conductive wire formed by a metal wire or printing in the interior of the substrate formed with such as a dielectric substance.

The antenna is enough with a chip antenna having the helical conductor formed by a metal wire or printing in the interior of the substrate formed with such as a dielectric substance, or a chip antenna formed with the helical conductor having the spiral part by the metal wire or printing in the interior of a laminated substrate.

The same is applied to a chip antenna formed on the substrate surface with the conductive wire or the helical conductor by the metal wire or the pattern printing. Those are shown in FIGS. 16 and 17.

(Embodiment 2)

In Embodiment 2, explanation will be made to the antenna module having a plurality of chip antennas. FIGS. 9, 10, 11, and 13 are the structures of the antenna module in Embodiment 2 of the invention. FIG. 12 is the equivalent circuit diagram of one part of the antenna module shown in FIG. 9.

Figure 9:
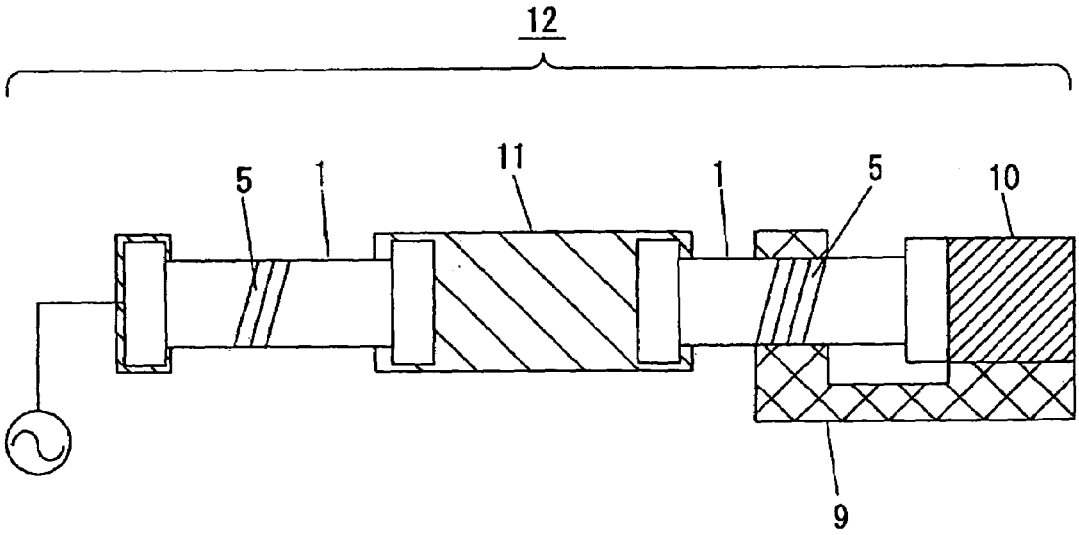
FIG. 9 is a structural view of the antenna module in Embodiment 2 of the invention.
Figure 10:
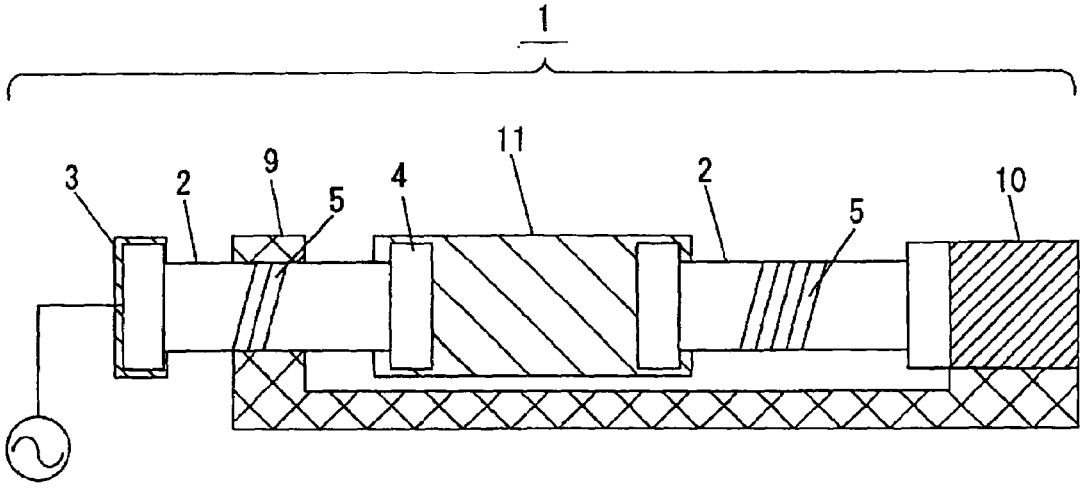
FIG. 10 is a structural view of the antenna module in Embodiment 2 of the invention.
Figure 11:
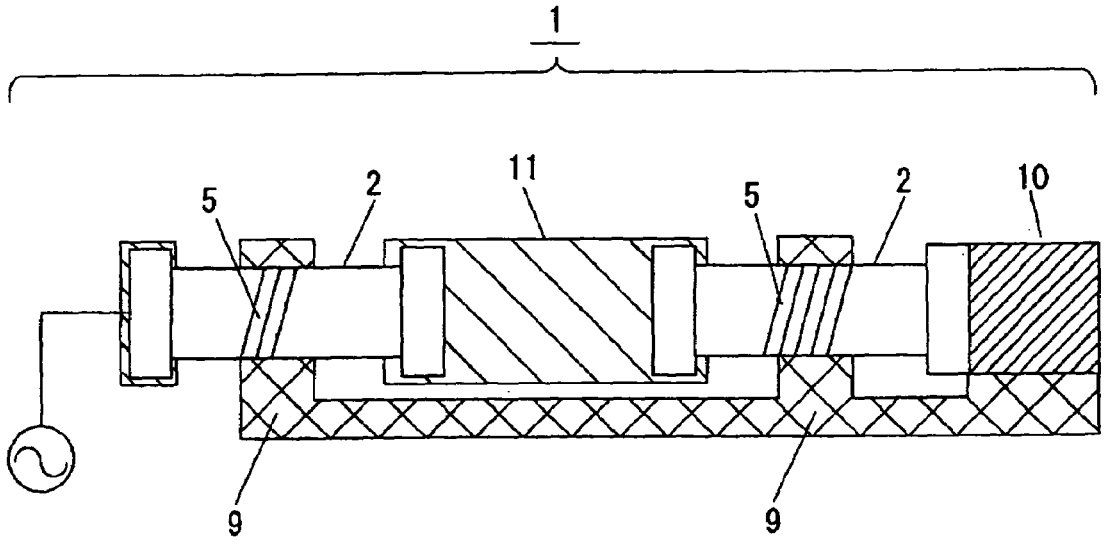
FIG. 11 is a structural view of the antenna module in Embodiment 2 of the invention.
Figure 12:
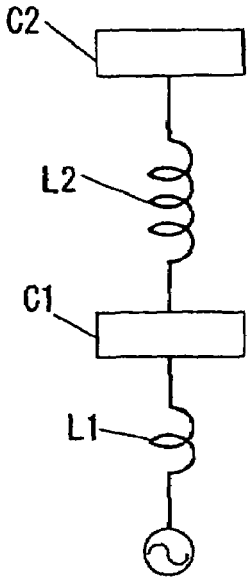
FIG. 12 is an equivalent circuit diagram of one part of the antenna module shown in FIG. 9.

FIGS. 9, 10 and 11 show the structures connected in series with the two chip antennas. Numerals 11 designates the connected conductor and 12 is the antenna module. The connected conductor 11 connects in series the two chip antennas. This connected conductor is formed with the mounted land, the soldered face or the metal film, and if the width direction is made not largely exceed the width direction of the chip antenna 1, the antenna module is miniaturized. The same is applied to the capacitive conductor. The signal current is sent to the chip antenna 1 via the feeding portion 7, and since the chip antenna 1 is connected in series via the connected conductor 11, the signal current is also sent to the chip antenna 1 previously connected via the connected conductor 11, and all of the chip antennas 1 are workable.

Also when the plurality of chip antennas 1 are arranged, since the inductor components are caused more than two, and those are connected via the capacitive components, the plurality of resonance conditions are built, and multiple resonances are realized. As seen from FIG. 12 of the equivalent circuit ignoring the capacitive conductor 9 from the antenna module 12 shown in FIG. 9, the inductor component and the capacitive component are mutually disposed by the existence of the plurality of chip antennas 1.

As apparently from the equivalent circuit diagram, this antenna module realizes two resonances of the signal transmittance and receipt in the resonance frequency responding to the resonance condition decided by L1 and C1, and the signal transmittance and receipt in the resonance frequency responding to the resonance condition decided by all of L1, L2, C1, and C2. For example, the resonance frequency of a short antenna decided by L1 and C1 responds to the using frequency of around 1.8 GHz of the portable telephone standardized by DCS, or the using frequency of around 1.9 GHz responding to the standard of GSM1900. On the other hand, a long antenna having the resonance frequency decided by L1, L2, C1, and C2 responds to the using frequency of 900 MHz of the portable telephone standardized by GSM. Those are merely examples, and are sufficient to the respective frequencies of wireless LAN using, for example, 2.4 GHz and 5 GHz.

The above mentioned is similar to the antenna module 12 shown in FIGS. 10 and 11, and the multiple resonance is realized.

Further, if respectively providing the capacitive conductors 9 in opposition to the helical parts 5 of the chip antennas 1, the broadband can be realized as explained in Embodiment 1. In the antenna module shown in FIG. 9, the capacitive conductor 9 is provided on the bottom of the helical part 5 of the chip antenna 1 at the side nearer to the additional conductor 10, and in the antenna module shown in FIG. 10, the capacitive conductor 9 is provided on the bottom of the helical part 5 of the chip antenna 1 at the side nearer to the feeding portion 7, and in the antenna module 12 shown in FIG. 11, the capacitive conductor 9 is provided on the bottom of both helical parts 5. Those are decided in response to the specification of the broadband. As to the providing manner, similarly to Embodiment 1, the mounting land or the substrate pattern are in advance provided, taking the positions on the mounting body into consideration, and thereafter, the chip antenna 1 is mounted.

The composite capacity of the antenna module 12 is made large by the existence and dimension of the capacitive component of the capacitive conductor 9, and the capacitive component is increased by the whole of the antenna module 12. By increasing the capacitive component, the impedance is flattened, and the broadband is realized. For example, assuming that C1 is the capacitive component caused from the periphery of the terminal part 3, C2 is the capacitive component of the connected conductor 11, C3 is the capacitive component of the additional conductor 10, and C4 is the capacitive component of the capacitive conductor, the composite capacity is shown with Formula (4).

$$C = \frac{(C1 + C2)(C3 + C4)}{C1 + C2 + C3 + C4} \tag{4}$$

As apparently from Formula (4), if C4 is large, the composite capacity is also large. That is, even in case of connecting the plurality of chip antennas 1 for realizing the multiple resonances, if disposing the capacitive conductor in opposition to the helical part, the broadband can be realized.

It is also suitable that the resonance frequency of the simplex chip antenna 1 responds to the low frequency, said simplex chip antenna 1 being firstly connected, via the connected conductor 11, to a lead end of the feeding portion 7. That is, this embodiment is realized by changing cyclic number of the trimming grooves 6 formed in the substrate 1. Because it is possible to efficiently generate the frequency resonating by only the chip antenna 1 at the side of the feeding portion 7 and the frequency resonating by the combined two resonating conditions. A reverse manner thereto is, of course, enough.

Not only two but also more than three of the chip antenna s 1 may be connected. Also in this case, if disposing the capacitive conductor in opposition to any or all of the respective helical parts, the broadband can be realized.

At this time, if disposing the plurality of chip antennas on the same straight line, the miniaturization is available in the width direction by making the best use of characteristics of the chip antenna 1 of the short helical system. Of course, it is sufficient to decide the chip antennas in agreement with the mounted articles or shapes of the accommodating case, or to fold the chip antenna at a basic line of the connected conductor.

Figure 13:
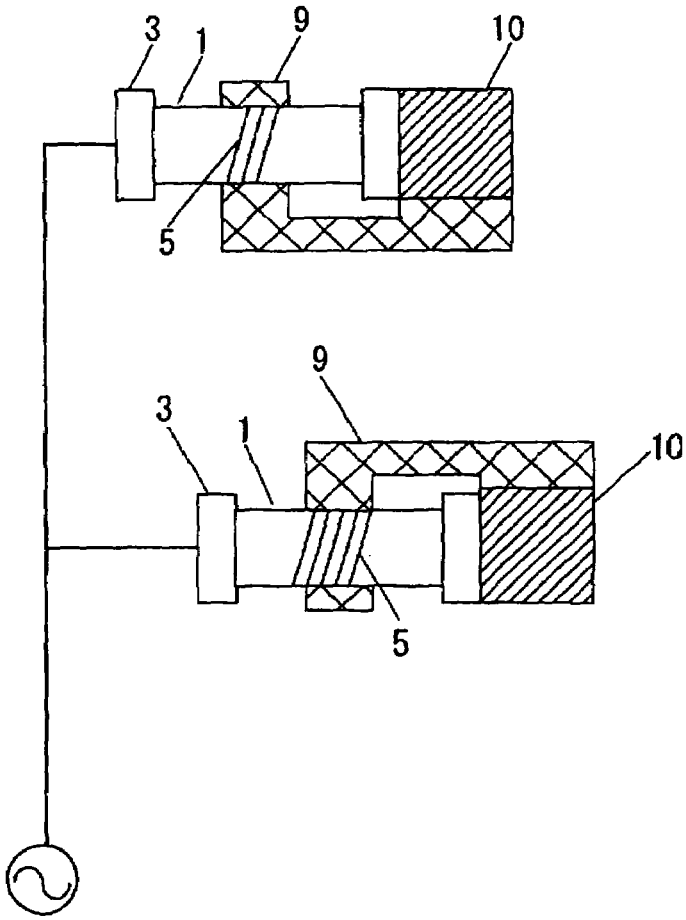
FIG. 13 is a structural view of the antenna module in Embodiment 2 of the invention.

For realizing the multiple resonances, the chip antennas 1 may be connected in parallel as shown in FIG. 13.

In FIG. 13, the two chip antennas 1 are connected in parallel to the feeding portion. The additional conductors 10 are provided at lead ends, and the capacitive conductors 9 connected thereto are disposed on the bottoms of the helical parts 5. In the respective chip antenna s 1, the cyclic number of the trimming grooves in the helical part 5 is different, so that the resonance frequencies are different, and this case is under the multiple resonating conditions of the resonance frequencies being different in the respective chip antenna s 1. Further, since the capacitive conductors are provided in opposition to the respective helical parts 5, the capacitive components are large, so that the broadband is realized.

In accordance with the specification of the antenna or the specification of the electronic instrument incorporating the antennas, the parallel connection is suitably served, and the multiple resonances and the broadband are realized maintaining miniaturized.

The above mentioned description has explained the case of using the helical antenna, and the same is applied to any of the helical antenna, for example, a winding typed helical antenna wound with a Cu wire on the substrate, the pattern antenna in the meander shape or a conductor antenna formed from the conductor.

Such a chip antenna is also enough, which is furnished with a conductive wire formed by a metal wire or printing in the interior of the substrate formed with such as a dielectric substance.

The antenna is enough with a chip antenna having the helical conductor formed by a metal wire or printing in the interior of the substrate formed with such as a dielectric substance, or a chip antenna formed with the helical conductor having the spiral part by the metal wire or printing in the interior of a laminated substrate.

The same is applied to a chip antenna formed on the substrate surface with the conductive wire or the helical conductor by the metal wire or the pattern printing. Those are shown in FIGS. 16 and 17.

(Embodiment 3)

Figure 14:
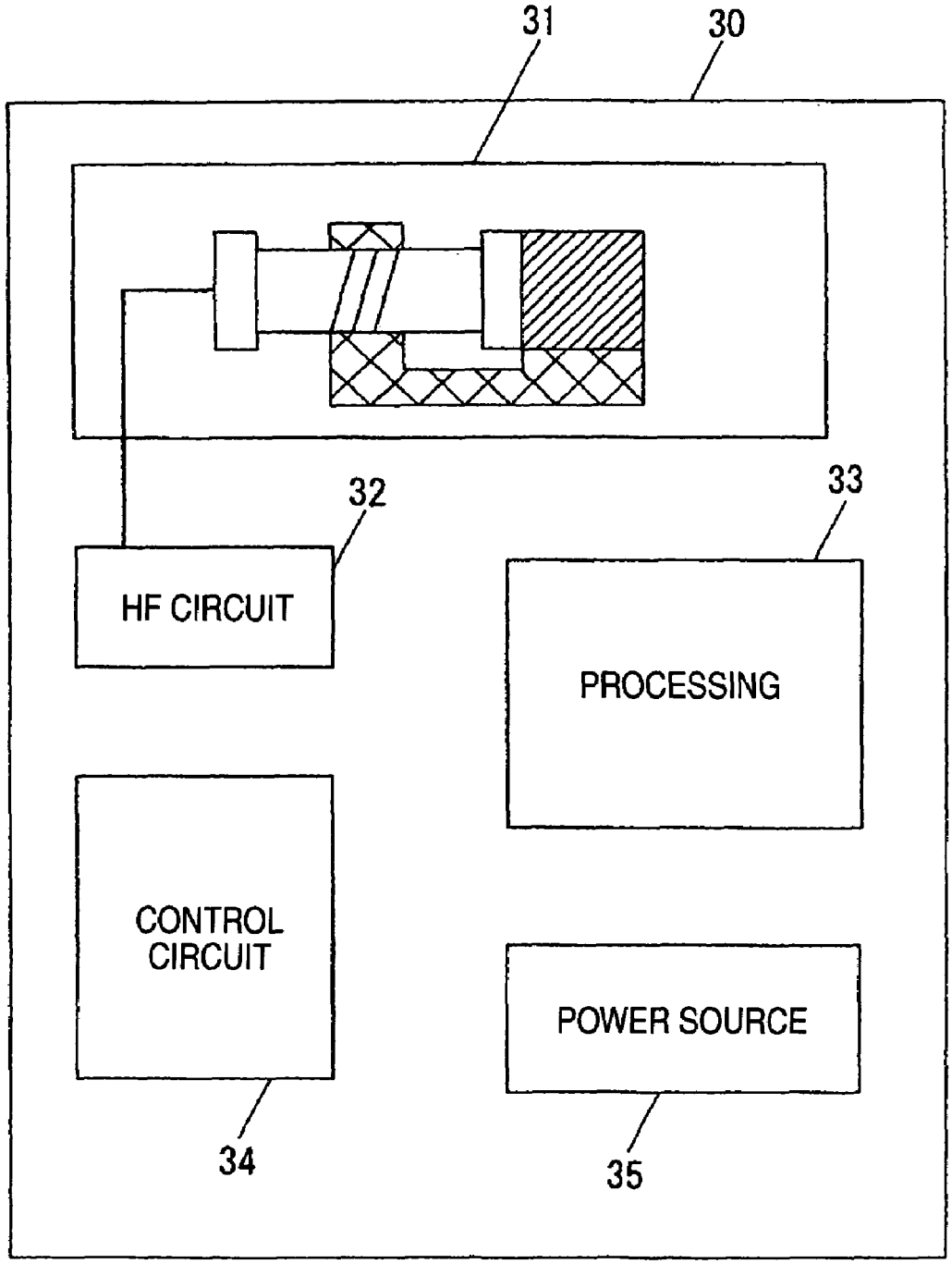
FIG. 14 is a structural view of the electronic instrument in Embodiment 3 of the invention.

FIG. 14 is a structural view of the electronic instrument in the embodiment 3 of the invention. The electronic instrument shown in FIG. 14 is the notebook personal computer, portable terminal, and portable telephone, and they are incorporated with the antenna module mounted with the chip antenna discussed in Embodiments 1 and 2.

Numeral 30 designates the case, 32 designates the high frequency circuit, 33 is a processing circuit, 34 is a control circuit, and 35 is an electric power source.

The case 30 is, for example, a case of the portable telephone, or of the notebook personal computer, and the case 30 may contain a display, a memory, a hard disc or an external storage medium.

The high frequency circuit applies high frequency signal current to the antenna module 31, or receives the high frequency signal received at the antenna module 31 and detects waves. The high frequency circuit contains a power amplifier necessary to signal transmission, a low noise amplifier used to signal reception, a switch of transmission and reception, a filter removing noises, a filter for selecting frequencies, a signal detection circuit, or a mixer, and respective discrete elements, parts or all of them are realized by an integrated circuit.

The processing circuit 33 carries out the processing of signals received by the high frequency circuit, the reproducing of signals, or the processing of signals to be transmitted. Those are realized by LSI, that is, detection, demodulation, and reproduction.

The demodulated data is, if needed, carried out with error-detection. For example, the error-detection is done by a cyclic redundancy check (called as "CRC") or a parity sign. Specifically, coincidence is detected between the parity sign of the signal transmitting side and an even parity or an odd parity of actually demodulated data. Or, in regard to the demodulated data, an error is divided by a generator multinominal expression, and is detected by confirming a remainder. When detecting the error, a processing as requesting re-sending of data is carried out.

Otherwise, the error may be corrected by decodes. In this case, since the detected error can be also corrected, the re-sending of data is any longer unnecessary, the performance of signal reception is consequently heightened.

The control circuit 34 contains CPU for controlling the whole of the electronic instrument, and executes a sequence control, a synchronous control, or a procedure control of each of the circuits. The control is performed by, for example, a program executed by CPU. The electric power source 35 employs a pack battery for supplying power to an interior circuit or the display.

In the portable telephone, portable terminal such as PDA, or the notebook personal computer being the examples of the electronic instruments, the miniaturization and thickness reduction are demanded to the utmost limits, and since the antenna module 31 is miniaturized as discussed in Embodiments 1 and 2, this contributes miniaturization of instruments. In addition, by the antenna module 31 realizing the broadband with the capacitive conductor, the signal transmittance and reception are possible in the broadband necessary to realization of mass data communications.

In the antenna module 31, if employing such antenna modules connected with chip antennas having the plurality of helical parts on the substrate or with the plurality of chip antennas, it is possible to realize multiple resonance covering 900 MHz of GSM band necessary, for example, to the portable telephone, 1800 MHz of DCS band, or 1900 MHz of GSM 1900. Or, it is possible to satisfy both of 2.4 GHz and 5 GHz in the wireless LAN used to the notebook typed personal computer. Besides, naturally, by adopting the antenna module 31, it is possible to realize the broadband maintaining miniaturization by providing the capacitive conductor making the use of the band region not allowing the mounted others to use.

Such an electronic instrument executes transmission and reception of necessary signals, modulation, demodulation and reproduction thereof, and the electronic instrument is also miniaturized.

(Embodiment 4)

Figure 15:
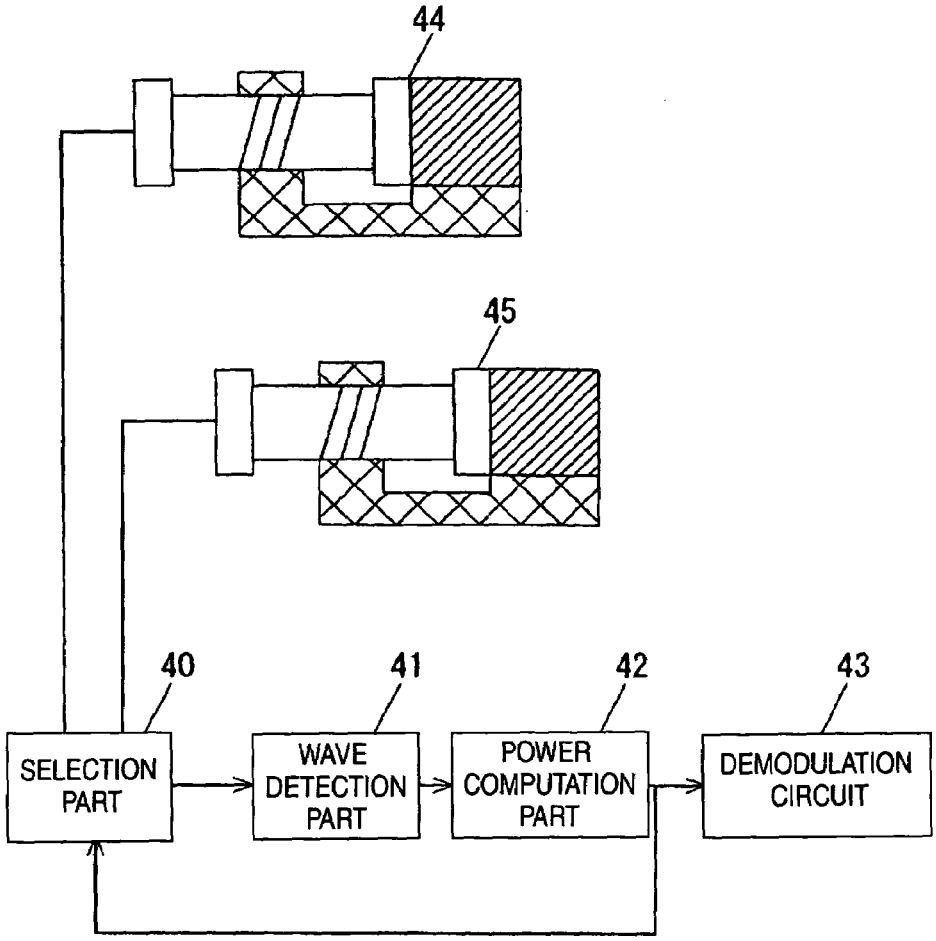
FIG. 15 is a structural view of the diversity device in Embodiment 4 of the invention.

FIG. 15 is a structural view of the diversity device in Embodiment 4 of the invention.

Two or more of chip antenna s are used to select signals of higher power among the received signals for improving signal receiving performance, or to compose for improving signal receiving performance.

Numeral 40 designates a selection part, 41 designates a detection part, 42 is a power computation part, 43 is a demodulation part, and 44, 45 are the antenna modules. The two antenna modules are provided.

A signal detected by the detection part 41 is subjected to a power computation in the power computation part 42. A computed power is compared with an optional threshold value, and a result is notified to the selection part 40. Being lower than the optional threshold value, this power is switched to another antenna module than the antenna module now used to receiving signals, and received. Being higher than the optional threshold value, the signal reception is continued as the antenna module now received.

Finally, the signal received by the selected antenna module is demodulated by the demodulation part 43, enabling to improve the signal reception performance.

Further, it is also suitable to carry out the composite diversity improving the signal receiving performance by carrying out composite of the signal, not by selection. In this case, a composite part is furnished instead of the selection part 40.

For example, if making the composite of a maximum ratio for demodulation in response to the ratio of the power computed by the power computation part 42, the ratio of C/N (the ratio of carrier: noise) causing the signal receiving performance, the signal receiving performance can be heightened.

Since the noise is non-correlative, even if being simple composite, a characteristic of at least around 3 dB is improved.

As mentioned above, if using the plurality of antenna modules for practicing the selection diversity or the composite diversity, the signal receiving performance can be improved, and even in this case, the multiple resonance or the broadband are realized, and the miniaturization of the chip antenna brings about the merit of little hindrance to the reduction in dimension of the electronic instrument for accommodating the plurality of antenna modules. Since the band region of transmitting and receiving signals by the individual antenna modules 44, 45 is the broadband, the transmittance and reception of signals can satisfy the mass data communications.

The invention has the structure comprising the mounting body, the chip antenna mounted on the mounting body and having the substrate and a couple of terminal parts provided on the substrate, the feeding portion to which one of the terminal parts provided on the mounting body is connected, the open portion to which the other of the terminal parts provided on the mounting body is connected, and the capacitive conductor provided between the mounting body and the substrate, not requiring any excessive mounting area on the bottom of the chip antenna when mounting, but efficiently increasing the capacitive component so as to further increase the effects of the broadband.

This application is based upon and claims the benefit of priority of Japanese Patent Application No. 2003-411477 filed on Dec. 10, 2003, the contents of which are incorporated herein by reference in its entirety.

What is claimed is:

1. An antenna module comprising:

a mounting body, a conductive pattern disposed on the mounting body, a chip antenna that comprises a substrate, a helical part and a couple of terminal parts, the chip antenna being disposed on the mounting body, a feeding portion to which one of the terminal parts is connected, the feeding portion being disposed on the mounting body, and an open portion to which the other of the terminal parts is connected, the open portion being disposed on the mounting body, wherein the conductive pattern is capacitively coupled to the helical part.

2. The antenna module as set forth in claim 1, wherein the conductive pattern is conducted to the open portion.

3. The antenna module as set forth in claim 1, wherein the open portion is connected with an additional conductor.

4. The antenna module as set forth in claim 1, wherein the helical part is formed by providing spiral grooves by trimming the said body part formed with a conductive film.

5. The antenna module as set forth in claim 1, wherein the helical part is formed by winding a conductive wire on the body part.

6. The antenna module as set forth in claim 1, wherein a plurality of the helical parts are provided on the substrate.

7. The antenna module as set forth in claim 1, wherein the chip antenna is provided with a protective film for covering at least a part of the helical part.

8. The antenna module as set forth in claim 1, wherein the helical part is provided in the interior of the body part.

9. The antenna module as set forth in claim 8, wherein the helical part comprises a conductive wire.

10. An electronic instrument comprising:

the antenna module set forth in claim 1, a high frequency circuit for transmitting and receiving signals necessary to the antenna module, a processing circuit connected to the high frequency circuit so as to process signals, and a control circuit for controlling the processing circuit and the high frequency circuit.

11. The electronic instrument as set forth in claim 10, wherein said electronic instrument is a portable terminal or a laptop computer.

12. A selective diversity device comprising:

a plurality of antenna modules set forth in claim 1, a selecting part configured to select signals received at said antenna modules, a wave detecting part configured to detect the received signals selected by the selecting part, and a power computation part configured to compute electric power of the signals detected by the wave detecting part wherein the selecting part selects the received signals in response to the computed results by the power computation part.

13. A selective diversity device comprising:

a plurality of antenna modules set forth in claim 1, a composite part configured to compose signals received at said antenna modules, a wave detecting part configured to detect the received signals selected by the selecting part, and a power computation part configured to compute electric power of the signals detected by the wave detecting part, wherein the composite part composes the received signals in response to the computed results by the power computation part.

14. The composite diversity as set forth in claim 13, wherein the composite of the received signal at the composite part is a maximum ratio.

15. An antenna module comprising:

a mounting body, a conductive pattern disposed on the mounting body, a plurality of chip antennas, each of which comprises a substrate, a helical part and a couple of terminal parts, the chip antennas being mounted on the mounting body, a feeding portion to which one of the terminal parts of one of the chip antennas is connected, the feeding part being disposed on the mounting body, and an open portion to which one of the terminal parts of another one of the chip antennas is connected, the open portion being disposed on the mounting body, wherein the conductive pattern is capacitively coupled to the helical part of said at least said another one of the chip antennas.

16. The antenna module as set forth in claim 15, wherein the conductive pattern is conducted to the open portion of said another one of the chip antennas.

17. The antenna module as set forth in claim 15, wherein the conductive pattern has a plurality of conductive parts, each of which faces the helical part of one of the plurality of chip antennas, the plurality of conductive parts being connected in series, the terminal parts being not connected to the conductive pattern.

* * * * *